US011104493B1

(12) United States Patent
Cox

(10) Patent No.: US 11,104,493 B1
(45) Date of Patent: Aug. 31, 2021

(54) POURING SPOUT ASSEMBLY

(71) Applicant: Stephen Cox, Rolling Meadows, IL (US)

(72) Inventor: Stephen Cox, Rolling Meadows, IL (US)

( * ) Notice: Subject to any disclaimer, the term of this patent is extended or adjusted under 35 U.S.C. 154(b) by 0 days.

(21) Appl. No.: 17/098,538

(22) Filed: Nov. 16, 2020

(51) Int. Cl.
*B65D 47/08* (2006.01)

(52) U.S. Cl.
CPC ..... *B65D 47/0866* (2013.01)

(58) Field of Classification Search
CPC .... B65D 47/0866; B65D 47/06; B65D 47/08; B65D 47/0857; B65D 47/043; B65D 47/0876
See application file for complete search history.

(56) References Cited

U.S. PATENT DOCUMENTS 435,207 A * 8/1890 Cohenius ..... B65D 47/0866 222/517
486,298 A * 11/1892 Ricker ..... B65D 47/0866 222/517
1,373,244 A 3/1921 Hernandez
1,788,181 A * 1/1931 Wolf ..... B65D 47/286 222/517
2,099,847 A * 11/1937 Gebauer ..... B65D 47/0866 222/425
2,126,087 A * 8/1938 Berry ..... B65D 47/0866 215/237
2,205,785 A * 6/1940 Benner ..... B65D 45/025 128/200.11
2,245,753 A * 6/1941 Brown ..... B67D 7/42 137/379
2,378,451 A * 6/1945 Vensel ..... B65D 47/0866 239/337
2,605,931 A 8/1952 Scannell
2,662,670 A 12/1953 Voight
2,717,102 A * 9/1955 Rives ..... B67B 7/28 222/89
3,395,740 A * 8/1968 Sutcliffe ..... B67D 7/48 141/392
3,474,837 A * 10/1969 Carder ..... B67D 7/421 141/392
3,759,423 A * 9/1973 Hansel ..... B67D 7/423 222/153.01
4,273,265 A * 6/1981 Anderson ..... B67D 3/044 222/189.01
4,801,053 A * 1/1989 Kaster ..... B67D 3/04 222/506
5,678,737 A 10/1997 White
6,364,176 B1 4/2002 Kilian
(Continued)

FOREIGN PATENT DOCUMENTS

WO WO2006007418 1/2006

*Primary Examiner* — Donnell A Long

(57) ABSTRACT

A pouring spout assembly for pouring fluid from a bottle without spillage includes a spout that is attachable to a bottle to pour a fluid contained in the bottle. A trigger is movably integrated into the spout that can be depressed by a user and the trigger is biased into an up-depressed position. A disk is coupled to the trigger such that the disk is positioned within the spout. The disk closes the spout when the trigger is not depressed to inhibit the fluid from pouring outwardly through the spout. Conversely, the disk opens the spout when the trigger is depressed to facilitate the liquid to pour from the spout.

15 Claims, 6 Drawing Sheets

(56) References Cited

U.S. PATENT DOCUMENTS

| | | | | |
|---|---|---|---|---|
| 6,793,104 | B2 | 9/2004 | Kao | |
| 6,983,868 | B1 * | 1/2006 | Harris | B65D 25/42 141/392 |
| 8,038,035 | B2 * | 10/2011 | Forbis | B65D 47/249 222/153.14 |
| D688,127 | S | 8/2013 | Agassi | |
| 8,631,837 | B2 * | 1/2014 | Lauber | B67D 7/426 141/59 |
| 2008/0142554 | A1 * | 6/2008 | Lafferty | A61M 5/16827 222/566 |
| 2011/0219860 | A1 * | 9/2011 | Tumarkin | B67D 7/54 73/114.45 |

* cited by examiner

POURING SPOUT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to spout devices and more particularly pertains to a new spout device for pouring a fluid from a bottle without spillage.

(2) Description of Related Art Including Information Disclosed Under 37 CFR 1.97 and 1.98

The prior art relates to spout devices including a variety of spouts that have mechanized means of controlling fluid flow from a bottle, generally involving a fluid valve of various designs. The prior art further discloses a variety of spouts that have an air inlet that can be covered by a user's finger for inhibiting fluid from pouring from the spout. The prior art also discloses a variety of spouts that include a trigger, that actuates a plunger, for opening and closing the spout for pouring. In no instance does the prior art disclose a flap, coupled to a trigger, for regulating the flow of fluid through a spout.

BRIEF SUMMARY OF THE INVENTION

An embodiment of the disclosure meets the needs presented above by generally comprising a spout that is attachable to a bottle to pour a fluid contained in the bottle. A trigger is movably integrated into the spout that can be depressed by a user and the trigger is biased into an up-depressed position. A disk is coupled to the trigger such that the disk is positioned within the spout. The disk closes the spout when the trigger is not depressed to inhibit the fluid from pouring outwardly through the spout. Conversely, the disk opens the spout when the trigger is depressed to facilitate the liquid to pour from the spout.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
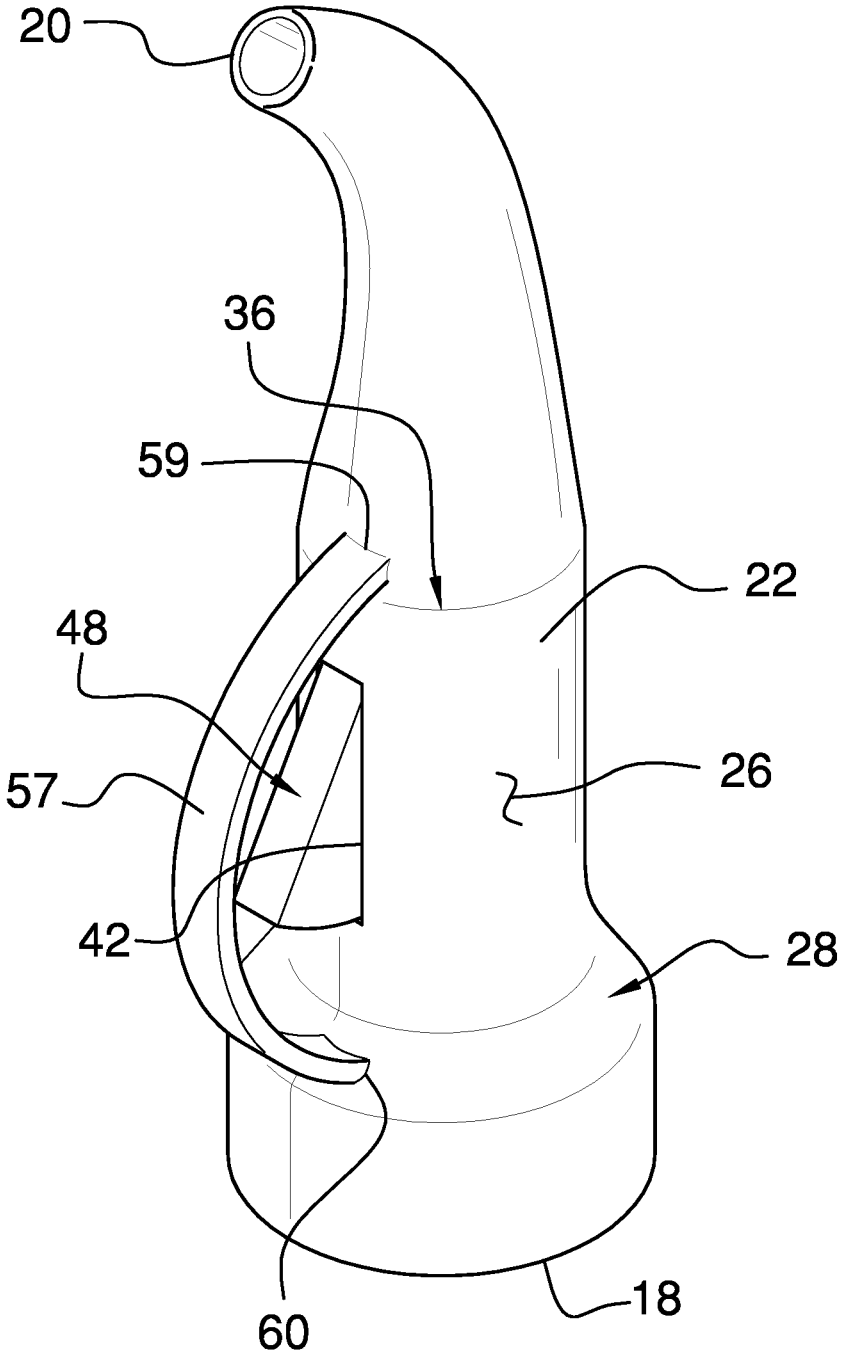
FIG. 1 is a perspective view of a pouring spout assembly according to an embodiment of the disclosure.
Figure 2:
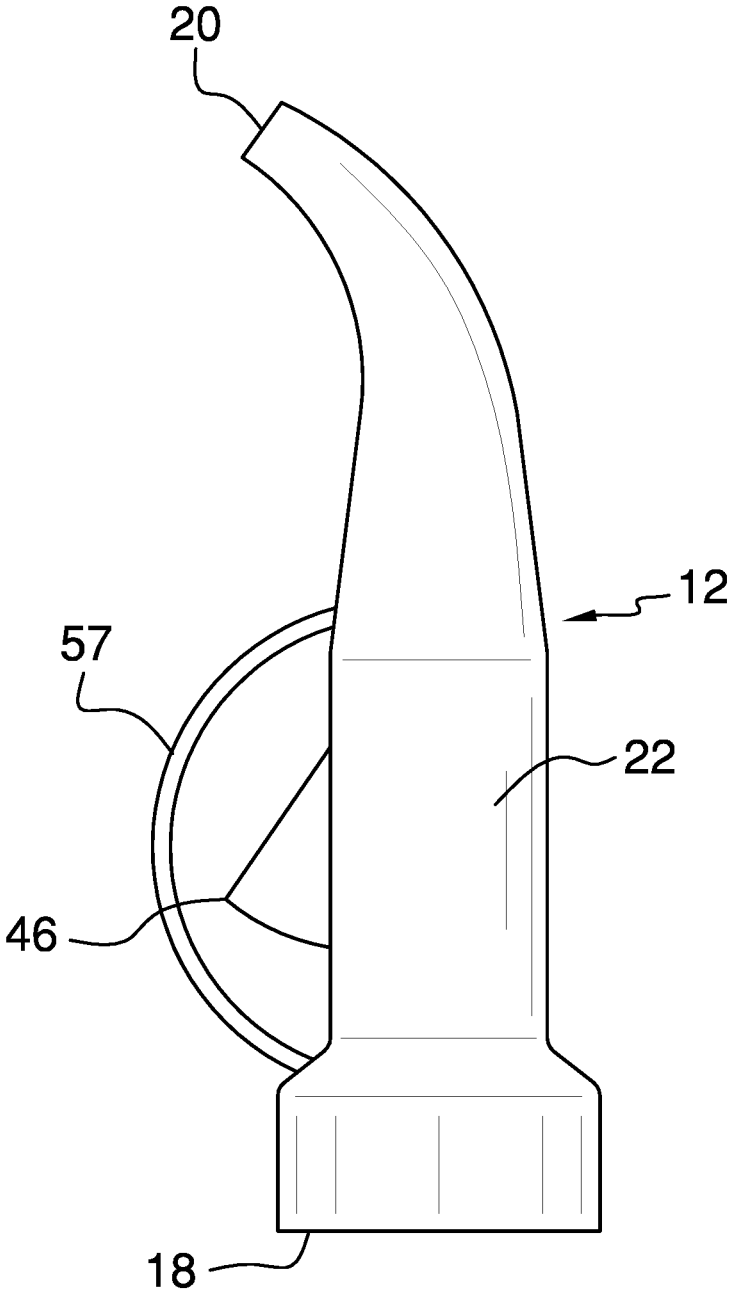
FIG. 2 is a left side view of an embodiment of the disclosure.
Figure 3:
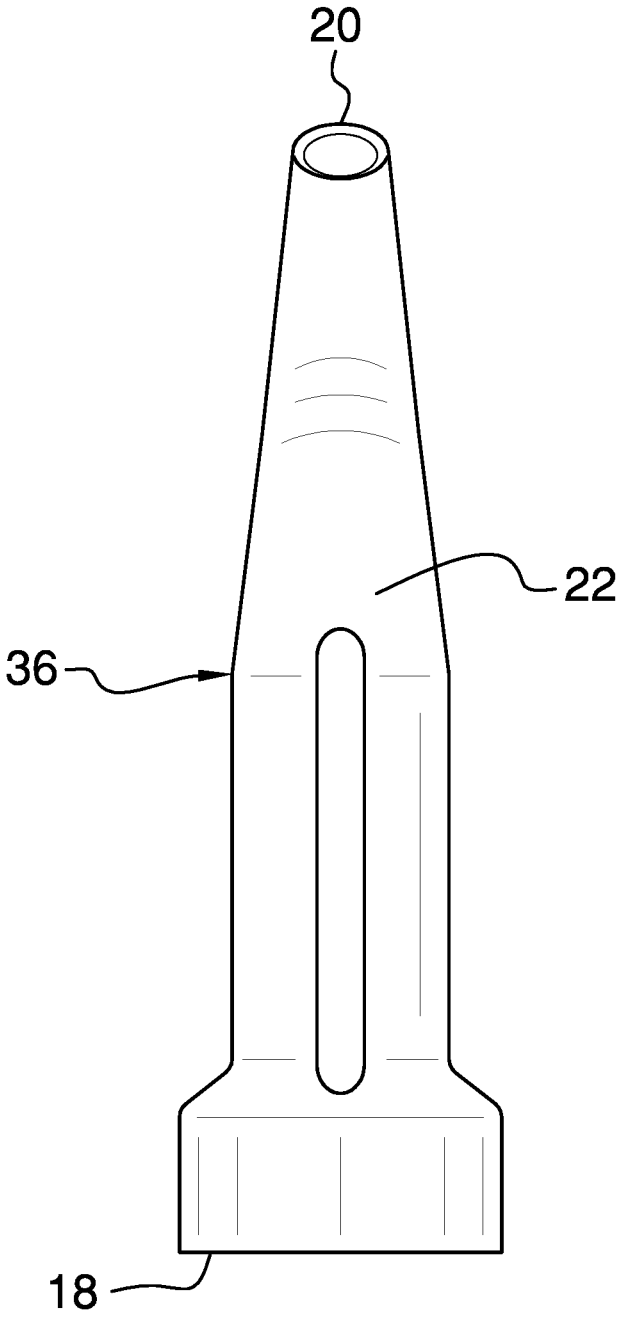
FIG. 3 is a front view of an embodiment of the disclosure.
Figure 4:
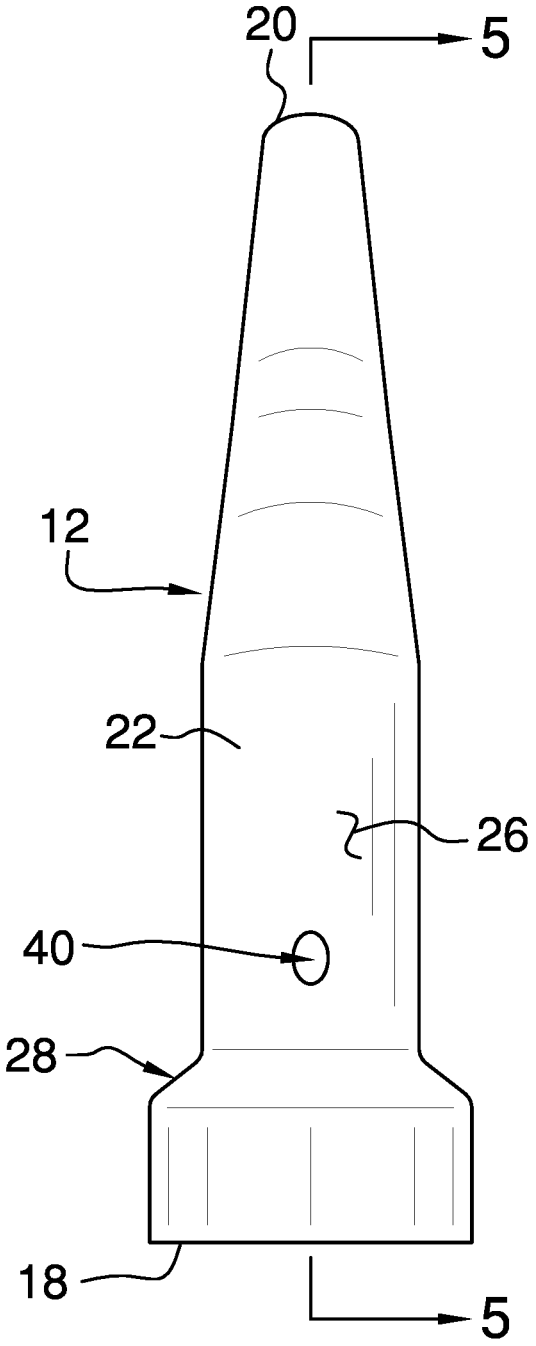
FIG. 4 is a back view of an embodiment of the disclosure.
Figure 5:
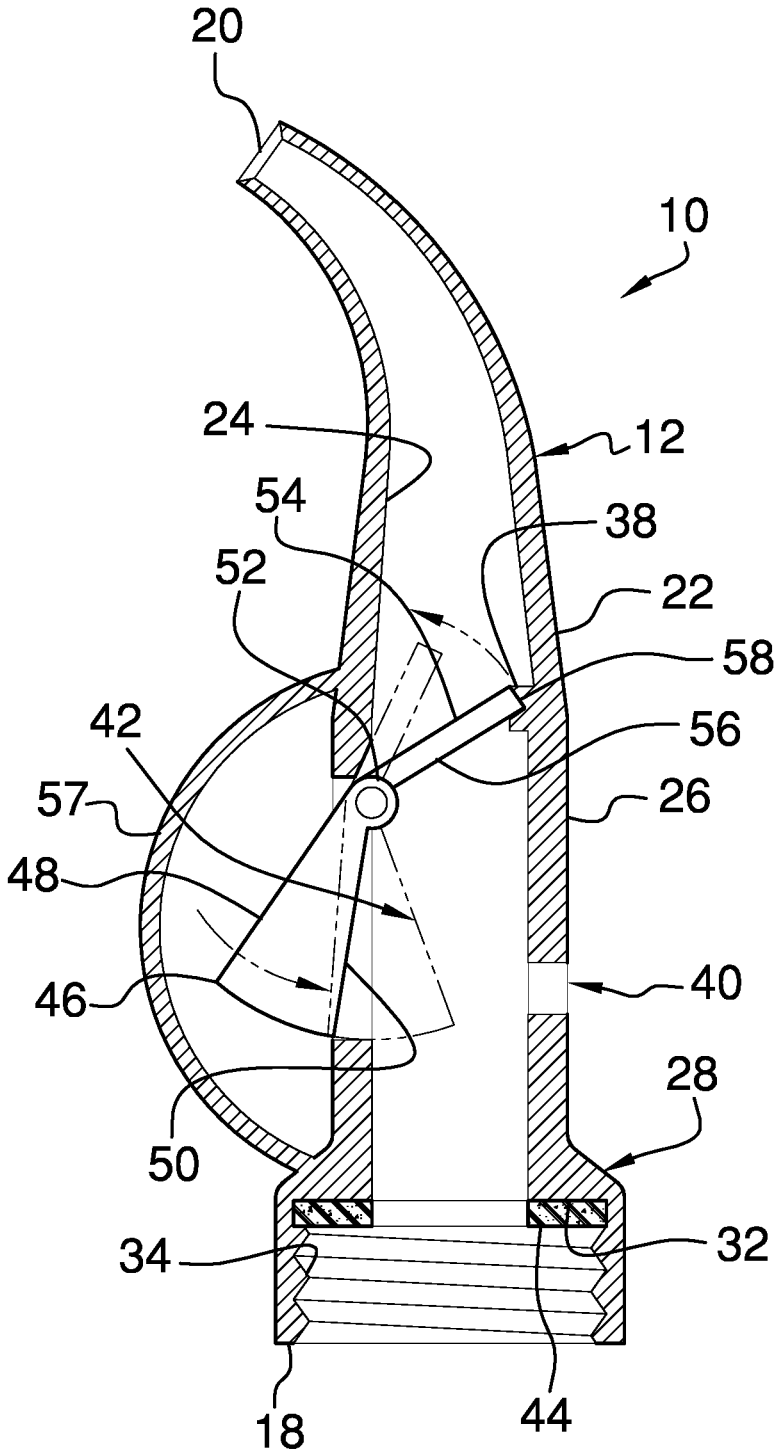
FIG. 5 is a cross sectional view taken along line 5-5 of FIG. 4 of an embodiment of the disclosure.
Figure 6:
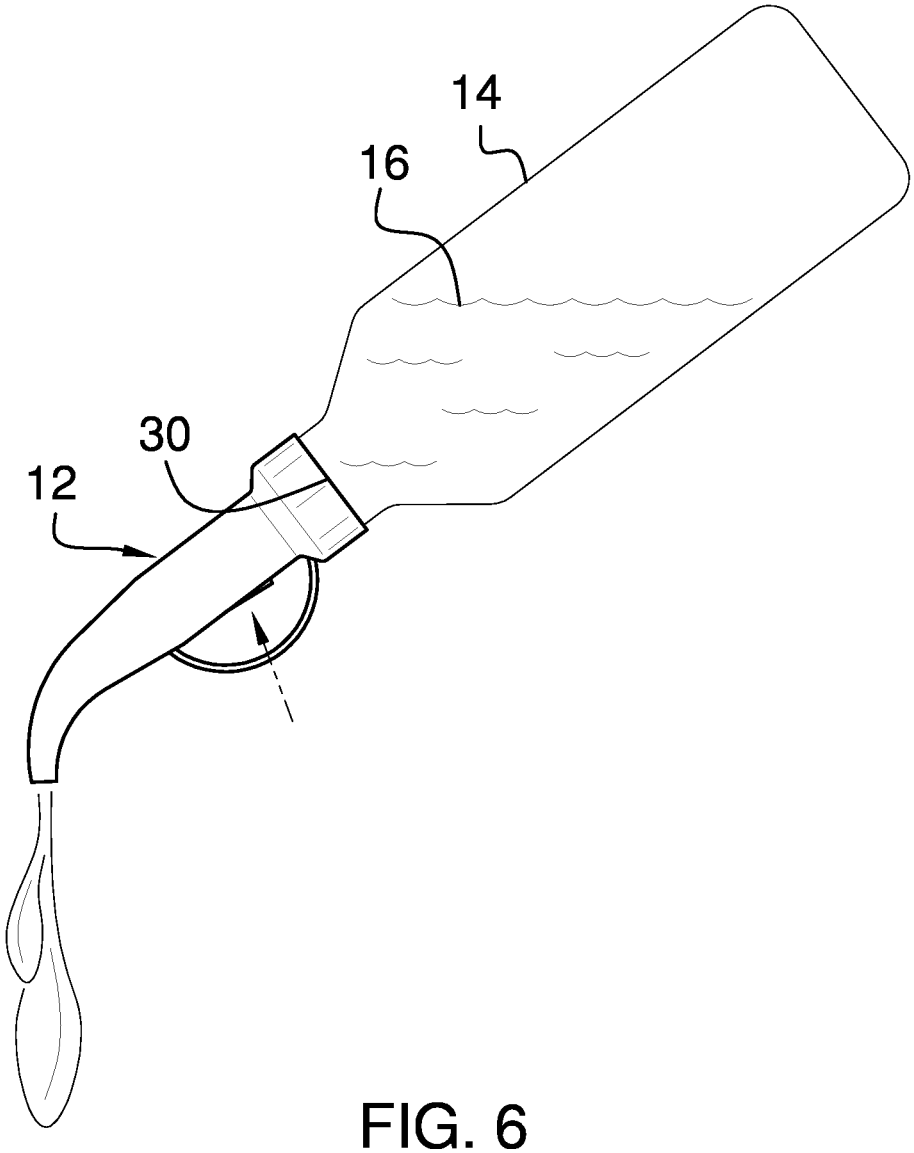
FIG. 6 is a perspective in-use view of an embodiment of the disclosure.

With reference now to the drawings, and in particular to FIGS. 1 through 6 thereof, a new spout device embodying the principles and concepts of an embodiment of the disclosure and generally designated by the reference numeral 10 will be described.

As best illustrated in FIGS. 1 through 6, the pouring spout assembly 10 generally comprises a spout 12 that is attachable to a bottle 14 to pour a fluid 16 contained in the bottle 14. The bottle 14 may be a glass bottle, a plastic bottle or any bottle that has a threaded neck. The fluid 16 may be any viscous fluid that can be poured from the bottle 14. The spout 12 has a bottom end 18, a top end 20 and an outer wall 22 extending therebetween, and each of the top end 20 and the bottom end 18 is open. The outer wall 22 has an inside surface 24 and an outside surface 26, and the outer wall 22 has a flared portion 28 that flares outwardly from a longitudinal centerline of the spout 12. The flared portion 28 is located adjacent to the bottom end 18 thereby facilitating the bottom end 18 to accommodate a top end 30 of the bottle 14. Additionally, the flared portion 28 has a bounding surface 32 that is oriented perpendicular to the inside surface 24 of the outer wall 22.

The inside surface 24 has a threaded portion 34 that is located adjacent to the bottom end 18 thereby facilitating the threaded portion 34 to threadably engage threads on the bottle 14 for retaining the spout 12 on the bottle 14. The outer wall 22 curves away from the longitudinal centerline of the spout 12 at a location that is positioned adjacent to the top end 20. In this way the top end 20 is directed laterally away from the longitudinal centerline of the spout 12 to enhance pouring the fluid 16 into a desired container or the like. The outer wall 22 tapers inwardly between a middle 36 of the outer wall 22 and the top end 20.

The inside surface 24 has a ledge 38 extending into an interior of the spout 12, and the ledge 38 is centrally positioned between the top end 20 and the bottom end 18. The outer wall 22 has an air hole 40 extending therethrough to pass air into the spout 12 when the spout 12 is pouring fluid 16. The air hole 40 is positioned between the ledge 38 and the flared portion 28 of the outer wall 22. The outer wall 22 has a trigger slot 42 extending therethrough and the trigger slot 42 is positioned adjacent to the flared portion 28 of the outer wall 22. The trigger slot 42 is positioned on an opposite side of the outer wall 22 with respect to the air hole 40.

A gasket 44 is positioned within the spout 12 and the gasket 44 is positioned against the bounding surface 32 of the flared portion 28 of the outer wall 22 of the spout 12. In this way the gasket 44 will compress against the top end 30 of the bottle 14 when the spout 12 is threaded onto the bottle 14. Additionally, the gasket 44 is comprised of a resiliently compressible material, including but not being limited to rubber or silicone, to form a fluid impermeable seal with the top end 30 of the bottle 14 thereby inhibiting fluid 16 from leaking outwardly through the bottom end 18 of the spout 12.

A trigger 46 is movably integrated into the spout 12 and the trigger 46 can be depressed by a user. The trigger 46 has a forward surface 48, a rearward surface 50 and an upper end 52 extending therebetween. The upper end 52 pivotally engages the outer wall 22 of the spout 12 having the trigger 46 being positioned in the trigger slot 42. The forward surface 48 is exposed with respect to the outer wall 22 to be engaged by the user for depressing the trigger 46 into the trigger slot 42. The rearward surface 50 is positioned inside the spout 12 and the trigger 46 is biased into an up-depressed position.

A disk 54 is coupled to the trigger 46 such that the disk 54 is positioned within the spout 12. The disk 54 closes the spout 12 when the trigger 46 is not depressed to inhibit the fluid 16 from pouring outwardly through the spout 12. The disk 54 opens the spout 12 when the trigger 46 is depressed to facilitate the fluid 16 to pour from the spout 12. The disk 54 has bottom surface 56 and a perimeter edge 58, and the perimeter edge 58 is coupled to the upper end 52 of the trigger 46. The perimeter edge 58 engages the inside surface 24 of the outer wall 22 of the spout 12. Additionally, the disk 54 is oriented such the bottom surface 56 lies on a plane that is oriented at an obtuse angle with respect to the rearward surface 50 of the trigger 46. In this way the weight of the disk 54 biases the trigger 46 into the un-depressed position.

The bottom surface 56 of the disk 54 rests on the ledge 38 on the inside surface 24 of the outer wall 22 of the spout 12 when the trigger 46 is in the un-depressed position. In this way the disk 54 inhibits the fluid 16 from passing beyond the disk 54. The bottom surface 56 of the disk 54 is displaced from the ledge 38 having the disk 54 angling upwardly toward the top end 20 of the spout 12 when the trigger 46 is depressed. In this way the disk 54 facilitates the fluid 16 to pass by the disk 54 to be poured from the spout 12.

A trigger guard 57 is provided and the trigger guard 57 is coupled to the spout 12. The trigger guard 57 extends over the trigger 46 to inhibit the trigger 46 from being inadvertently depressed. The trigger guard 57 has a primary end 59 and a secondary end 60, and the trigger guard 57 is curved between the primary end 59 and the secondary end 60. Moreover, each of the primary end 59 and the secondary end 60 is coupled to the outer wall 22 of the spout 12 having the trigger guard 57 being aligned with the trigger 46.

In use, the bottom end 18 of the spout 12 is threaded onto the top end 20 of the bottle 14 to facilitate the spout 12 to pour the fluid 16 in the bottle 14. The trigger 46 is depressed to facilitate the fluid 16 to pour from the spout 12. Additionally, the fluid 16 ceases pouring from the spout 12 when the trigger 46 is released. In this way the volume of fluid 16 that is poured from the spout 12 can be precisely controlled without spillage, as commonly occurs when one resorts to tipping the bottle 14 upwardly to stop pouring the fluid 16. In this way oil, for example, can be poured into an oil fill tube on an internal combustion engine without fear of spilling the oil or overfilling the internal combustion engine with oil.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pouring spout assembly for inhibiting a fluid from being poured from a bottle until a trigger on the pouring spout is manipulated thereby inhibiting fluid from spilling from the bottle, said assembly comprising:

a spout being attachable to a bottle wherein said spout is configured to pour a fluid contained in the bottle;

a trigger being movably integrated into said spout wherein said trigger is configured to be depressed by a user, said trigger being biased into an up-depressed position;

a disk being coupled to said trigger such that said disk is positioned within said spout, said disk closing said spout when said trigger is not depressed wherein said disk is configured to inhibit the fluid from pouring outwardly through said spout, said disk opening said spout when said trigger is depressed wherein said disk is configured to facilitate the liquid to pour from said spout; and a trigger guard being coupled to said spout, said trigger guard extending over said trigger wherein said trigger guard is configured to inhibit said trigger from being inadvertently depressed.

2. The assembly according to claim 1, wherein said spout has a bottom end, a top end and an outer wall extending therebetween, each of said top end and said bottom end being open, said outer wall having an inside surface and an outside surface, said outer wall having a flared portion that flares outwardly from a longitudinal centerline at a location being located adjacent to said bottom end thereby facilitating said bottom end to accommodate a top of the bottle, said flared portion having a bounding surface being oriented perpendicular to said inside surface of said outer wall.

3. The assembly according to claim 2, wherein said inside surface has a threaded portion being located adjacent to said bottom end thereby facilitating said threaded portion to threadably engage threads on the bottle for retaining said spout on the bottle.

4. The assembly according to claim 2, wherein said outer wall curves away from said longitudinal centerline of said spout at a location being positioned adjacent to said top end such that said top end is directed laterally away from said longitudinal centerline of said spout wherein said spout is configured to enhance pouring the liquid into a container.

5. The assembly according to claim 2, wherein said outer wall tapers inwardly between a middle of said outer wall and said top end.

6. The assembly according to claim 2, wherein said inside surface has a ledge extending into an interior of said spout, said ledge being centrally positioned between said top end and said bottom end.

7. The assembly according to claim 6, wherein said outer wall has an air hole extending therethrough wherein said air hole is configured to pass air therethrough when said spout is pouring liquid, said air hole being positioned between said ledge and said flared portion of said outer wall.

8. The assembly according to claim 7, wherein said outer wall has a trigger slot extending therethrough, said trigger slot being positioned adjacent to said flared portion of said outer wall, said trigger slot being positioned on an opposite side of said outer wall with respect to said air hole.

9. The assembly according to claim 8, wherein said trigger has a forward surface, a rearward surface and an upper end extending therebetween, said upper end pivotally engaging said outer wall of said spout having said trigger being positioned in said trigger slot, said forward surface being exposed with respect to said outer wall wherein said forward surface is configured to be engaged by the user for depressing said trigger into said trigger slot, said rearward surface being positioned inside said spout.

10. The assembly according to claim 9, wherein said disk has a bottom surface and a perimeter edge, said perimeter edge being coupled to said upper end of said trigger, said perimeter edge engaging said inside surface of said outer wall of said spout, said disk being oriented such said bottom surface lies on a plane being oriented at an obtuse angle with respect to said rearward surface of said trigger wherein the weight of said disk biases said trigger into said un-depressed position.

11. The assembly according to claim 10, wherein said bottom surface of said disk rests on said ledge on said inside surface of said outer wall of said spout when said trigger is in said un-depressed position wherein said disk is configured the fluid to pass beyond said disk.

12. The assembly according to claim 10, wherein said bottom surface of said disk is displaced from said ledge having said disk angling upwardly toward said top end of said spout when said trigger is depressed wherein said disk is configured to facilitate the fluid to pass by said disk.

13. The assembly according to claim 2, further comprising a gasket being positioned within said spout, said gasket being positioned against said bounding surface of said flared portion of said outer wall of said spout wherein said gasket is configured to compress against the top of the bottle when said spout is threaded onto the bottle, said gasket being comprised of a resiliently compressible material wherein said gasket is configured to form a fluid impermeable seal with the top of the bottle thereby inhibiting fluid from leaking outwardly through said bottom end of said spout.

14. The assembly according to claim 2, wherein said trigger guard has a primary end and a secondary end, said trigger guard being curved between said primary end and said secondary end, each of said primary end and said secondary end being coupled to said outer wall of said spout having said trigger guard being aligned with said trigger.

15. A pouring spout assembly for inhibiting a fluid from being poured from a bottle until a trigger on the pouring spout is manipulated thereby inhibiting fluid from spilling from the bottle, said assembly comprising:

a spout being attachable to a bottle wherein said spout is configured to pour a fluid contained in the bottle, said spout having a bottom end, a top end and an outer wall extending therebetween, each of said top end and said bottom end being open, said outer wall having an inside surface and an outside surface, said outer wall having a flared portion that flares outwardly from a longitudinal centerline of said spout at a location being located adjacent to said bottom end thereby facilitating said bottom end to accommodate a top of the bottle, said flared portion having a bounding surface being oriented perpendicular to said inside surface of said outer wall, said inside surface having a threaded portion being located adjacent to said bottom end thereby facilitating said threaded portion to threadably engage threads on the bottle for retaining said spout on the bottle, said outer wall curving away from said longitudinal centerline of said spout at a location being positioned adjacent to said top end such that said top end is directed laterally away from said longitudinal centerline of said spout wherein said spout is configured to enhance pouring the liquid into a container, said outer wall tapering inwardly between a middle of said outer wall and said top end, said inside surface having a ledge extending into an interior of said spout, said ledge being centrally positioned between said top end and said bottom end, said outer wall having an air hole extending therethrough wherein said air hole is configured to pass air therethrough when said spout is pouring liquid, said air hole being positioned between said ledge and said flared portion of said outer wall, said outer wall having a trigger slot extending therethrough, said trigger slot being positioned adjacent to said flared portion of said outer wall, said trigger slot being positioned on an opposite side of said outer wall with respect to said air hole;

a gasket being positioned within said spout, said gasket being positioned against said bounding surface of said flared portion of said outer wall of said spout wherein said gasket is configured to compress against the top of the bottle when said spout is threaded onto the bottle, said gasket being comprised of a resiliently compressible material wherein said gasket is configured to form a fluid impermeable seal with the top of the bottle thereby inhibiting fluid from leaking outwardly through said bottom end of said spout;

a trigger being movably integrated into said spout wherein said trigger is configured to be depressed by a user, said trigger having a forward surface, a rearward surface and an upper end extending therebetween, said upper end pivotally engaging said outer wall of said spout having said trigger being positioned in said trigger slot, said forward surface being exposed with respect to said outer wall wherein said forward surface is configured to be engaged by the user for depressing said trigger into said trigger slot, said rearward surface being positioned inside said spout, said trigger being biased into an up-depressed position;

a disk being coupled to said trigger such that said disk is positioned within said spout, said disk closing said spout when said trigger is not depressed wherein said disk is configured to inhibit the fluid from pouring outwardly through said spout, said disk opening said spout when said trigger is depressed wherein said disk is configured to facilitate the liquid to pour from said spout, said disk having bottom surface and a perimeter edge, said perimeter edge being coupled to said upper end of said trigger, said perimeter edge engaging said inside surface of said outer wall of said spout, said disk being oriented such said bottom surface lies on a plane being oriented at an obtuse angle with respect to said rearward surface of said trigger wherein the weight of said disk biases said trigger into said un-depressed position, said bottom surface of said disk resting on said ledge on said inside surface of said outer wall of said spout when said trigger is in said un-depressed position wherein said disk is configured the fluid to pass beyond said disk, said bottom surface of said disk being displaced from said ledge having said disk angling upwardly toward said top end of said spout when said trigger is depressed wherein said disk is configured to facilitate the fluid to pass by said disk; and a trigger guard being coupled to said spout, said trigger guard extending over said trigger wherein said trigger guard is configured to inhibit said trigger from being inadvertently depressed, said trigger guard having a primary end and a secondary end, said trigger guard being curved between said primary end and said secondary end, each of said primary end and said secondary end being coupled to said outer wall of said spout having said trigger guard being aligned with said trigger.

* * * * *